US005779451A

United States Patent [19]

Hatton

[11] Patent Number: 5,779,451

[45] Date of Patent: Jul. 14, 1998

[54] POWER EFFICIENT MULTI-STAGE TWIN SCREW PUMP

[76] Inventor: Gregory John Hatton, 3207 Rambling Creek Dr., Kingwood, Tex. 77345

[21] Appl. No.: 671,696

[22] Filed: Jun. 28, 1996

Related U.S. Application Data

[62] Division of Ser. No. 463,205, Jun. 5, 1995, abandoned.

[51] Int. Cl.[6] ..... F04C 2/16; F04C 13/00; F04B 23/12

[52] U.S. Cl. ..... 417/205; 418/9; 418/15; 418/201.2; 418/202

[58] Field of Search ..... 417/205; 418/9, 418/15, 201.1, 201.2, 202

[56] References Cited

U.S. PATENT DOCUMENTS

| | | | |
|---|---|---|---|
| 1,317,370 | 9/1919 | Holdaway | 418/9 |
| 4,684,335 | 8/1987 | Goodridge | 418/202 |

FOREIGN PATENT DOCUMENTS

| | | | |
|---|---|---|---|
| 2245493 | 10/1990 | Japan | 418/201.1 |
| 2294589 | 12/1990 | Japan | 418/15 |
| 1820035 | 6/1993 | Russian Federation | 418/9 |
| 1083197 | 9/1967 | United Kingdom | 418/9 |

*Primary Examiner*—John J. Vrablik
*Attorney, Agent, or Firm*—Philip T. Golden; Winstead Sechrest & Minick

[57] ABSTRACT

There is disclosed an apparatus for pumping multiphase fluids in oil field production, particularly a twin-screw pump for providing a large pressure boost to high gas-fraction inlet streams. The pump includes a housing having an internal rotor enclosure, the enclosure having an inlet and an outlet and a plurality of rotors operably contained in the enclosure. Each rotor has a shaft and a plurality of outwardly extending threads affixed thereon, the rotors being shaped to provide a non-uniform volumetric delivery rate along the length of each rotor. The pump also has means for rotating the rotors, whereby a fluid stream entering from the inlet is subjected to a pumping action to transport the fluid stream to exit the rotor enclosure through the outlet. In one embodiment, the rotors have a plurality of threaded pumping stages separated by unthreaded non-pumping chambers. Further, the threads of each pumping stage may have a different screw profile to provide progressively decreasing inlet volumetric delivery rates from the inlet to the outlet of the rotor enclosure. The multiple stages provide better power efficiency than traditional twin-screw pumps for high-pressure boost operation at gas fractions up to 100% without seizing or loss of pressure boost.

5 Claims, 8 Drawing Sheets

POWER EFFICIENT MULTI-STAGE TWIN SCREW PUMP

This application is a division of application Ser. No. 08/463,205 filed Jun. 5, 1995, abandoned.

FIELD OF THE INVENTION

This invention generally relates to an apparatus for pumping multiphase fluids as in oil field production, particularly to a twin-screw pump for providing a large pressure boost to high gas-fraction inlet streams. More specifically, the invention relates to a twin-screw pump having multiple stages or a progressive stage to provide better power efficiency than traditional twin-screw pumps for high-pressure boost operation at gas fractions up to 100% without seizing or loss of pressure boost.

BACKGROUND OF THE INVENTION

Drilling for oil and gas is an expensive, high-risk business, even when the drilling is carried out in a proven field. Petroleum development and production must be sufficiently profitable over the long term to withstand a variety of economic uncertainties. Multiphase pumping is increasingly being used to aid in the production of wellhead fluids. Both surface and subsea installations of these pumps are increasing well production. Multiphase pumps are particularly helpful in producing remote fields and many companies are considering their use for producing remote pockets of oil and for producing deep water reservoirs from shallower water facilities. These pumps allow producers to transport wellhead fluids (oil, water, and gas) to distant processing facilities (instead of building new processing facilities near the wellheads). These pumps also allow lower final reservoir pressures before abandoning production and consequently a greater total recovery from the reservoir.

For deep water reservoirs., producers are very interested in using multiphase pumps to transport wellhead fluids from deep waters to shallow water processing facilities. While there are a number of technical difficulties in this type of production, the cost savings are very large. To build processing facilities over reservoirs in waters of 6,000 to 10,000 feet deep cost tens of billions of dollars, as compared to a cost of hundreds of millions of dollars to build such facilities in moderate water depths of 400 to 600 feet. Consequently, producers would like to transport wellhead fluids from the sea-floor in deep waters through pipelines to processing facilities in moderate water depths.

Currently, transport distances of 30 to 60 miles are being considered. In many locations around the world, a 30 to 60 mile reach from the edge of the continental shelf into deeper waters significantly increases the number of oil reservoirs which could be produced. In the Gulf of Mexico, for example, such a reach from water depths of 600 feet typically goes to water depths of 6,000 feet and deeper. In the near future, greater reaches up to 100 miles are envisioned. Multiphase pumps are a design being considered for supplying the pressure boost required for this long-distance transport of wellhead fluids. They are typically connected at one end to a Christmas tree manifold, whose casing head is attached to the top of wells from which fluids flow as a result of indigenous reservoir energy, and at the other end to a pipeline which transports the fluids to the remote processing site.

Wellhead fluids can exhibit a wide range of chemical and physical properties. These wellhead fluid properties can differ from zone to zone within a given field and can change with time over the course of a well's life. Furthermore, well bore flow exhibits a well-known array of flow regimes, including slug flow, bubble flow, stratified flow, and annular mist, depending on flow velocity, geometry, and the aforementioned fluid properties. Consequently, the ideal multiphase pump should allow for a broad range of input and output parameters without unduly compromising pumping efficiency and service life.

Pumping gas-entrained liquids of varying gas content presents a difficult design problem. Some pumps that have been used include twin-screw pumps, helico-axial pumps, counter-rotating axial-flow pumps, piston pumps, and diaphragm pumps. Twin-screw pumps are one of the favored types of pump for handling the wide range of liquid/gas ratios found in wellhead fluids. Nevertheless, this type of pump has its detractors. For example, one well-known problem for twin-screw pumps is pump seizing.

A twin-screw pump has two rotors that rotate in a close-fitting casing (rotor enclosure). For a given inlet volumetric rate, gas fraction increases result in mass rate reductions, decreases in the thermal transport capacity of the pumped fluids, and temperature elevations in the pump. Consequently, at high pressure boosts, for a given set of operating conditions, a critical gas fraction exists. Pumping at gas fractions greater than the critical gas fraction will result in excessive heating of the pump rotors causing an expansion of the rotors such that the rotors will interfere with the pump body (rotor enclosure) causing the pump to seize.

In typical oil field applications, the gas fraction (or percentage of gas content of the wellhead fluid by volume at inlet conditions) is required to be less than some upper limit for a given pump pressure boost. This limit is typically around 95 to 97% gas fraction for pressure boosts of around 900 psi. In order to ensure that wellhead fluids do not exceed this requirement, several approaches have been taken including: (1) buffer tanks have been added upstream of the pump to dampen excessive gas/liquid ratio variations, (2) liquids from the pump outlet or other liquids are commingled with the inlet stream to reduce the inlet gas fraction, or (3) combinations of 1 and 2 are used to reduce the inlet gas fraction. Method I extends the operational range of the pump marginally, and methods 2 and 3 extend the operating range a little more but are extremely inefficient. Even with these approaches, pump seizing may still occur.

A more power efficient twin-screw pump would have several advantages over traditional twin-screw pumps. These advantages include (1) reduced likelihood of seizing since less heat is generated within the pumping chamber, (2) reduced requirement for recirculation systems which further reduce the efficiency and consequently generate more heat which must be removed from the pumping chamber in order to prevent seizing, (3) reduced drive requirements (for example, electric motors), thus reducing initial capital investment and providing a smaller and less massive system, (4) reduced power transmission capacity requirements (for example, a fifty mile subsea electrical power transmission system used with a common pump size costs millions of dollars and typically has transformers, special variable frequency drives, and other special equipment for long distance transmissions), thus reducing initial capital investment, (5) lower operating costs (for less power, typically pumps of several mega-watts size are considered), (6) lower maintenance and servicing costs (this is due to longer lifetime at lower power loads and reducing servicing costs due to reduced weight of the drive—recovering a subsea pump for servicing or replacement is very expensive and the required vessel size and time for this is dependent on the size and weight of the pump/drive system), and (7) an economical system in situations where a standard twin-screw pump system costs more than the value received by using it.

Therefore, there is a need for a power efficient twin-screw pump capable of providing a large pressure boost to high gas-fraction inlet streams without seizing or loss of pressure boost.

SUMMARY OF THE INVENTION

The present invention relates to a pump which includes a housing having an internal rotor enclosure, the enclosure having an inlet and an outlet and a plurality of rotors operably contained in the enclosure. Each rotor has a shaft and a plurality of outwardly extending threads affixed thereon, the rotors being shaped to provide a non-uniform volumetric delivery rate along the length of each rotor. The pump also has means for rotating the rotors, whereby a fluid stream entering from the inlet is subjected to a pumping action to transport the fluid stream to exit the rotor enclosure through the outlet.

In one embodiment, the rotors have a plurality of threaded pumping stages separated by unthreaded non-pumping chambers. Further, the threads of each pumping stage may have a different screw profile to provide progressively decreasing inlet volumetric delivery rates from the inlet to the outlet of the rotor enclosure. In another embodiment, each non-pumping chamber may have an increased rotor enclosure diameter.

In another aspect of the present invention, each non-pumping chamber is connected to the outlet of the rotor enclosure by a plurality of fluid lines. If desired, a check valve may be connected to the fluid line and disposed between the non-pumping chamber and the outlet of the rotor enclosure to prevent fluids from entering the chamber from the outlet. In another embodiment, a plurality of pumps may be connected to the fluid line between the check valve and the outlet for pumping the fluids towards the outlet.

Yet another embodiment entails the pump described above with means for cooling the rotors and/or sealing the rotor chambers at the outlet end of the pump. The cooling means may be means for injecting liquid onto a portion of said rotors and/or into said rotor chambers. Alternatively, the cooling means may comprise means for pooling a liquid in an outlet chamber of said pump. In another embodiment, the cooling means comprises a thermally conductive conduit containing a heat absorbing liquid which is positioned within the rotor enclosure where the rotor shafts are unthreaded. There is also provided means for cooling the liquid and means for circulating the liquid between the cooling means and the conduit positioned within the rotor enclosure.

The foregoing has outlined rather broadly the features and technical advantages of the present invention so that the detailed description of the invention that follows may be better understood. Additional features and advantages of the invention will be described hereinafter which form the subject of the claims of the invention. It should be appreciated by those skilled in the art that the conception and the specific embodiment disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and form a part of the specification, illustrate the embodiments of the present invention, and, together with the description, serve to explain the principles of the invention. In the drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

This invention is directed to a multistage twin-screw pump that provides a large pressure boost to high gas-fraction inlet streams with less pressure. Reduction of power usage not only reduces power requirements, it also reduces the chances of pump seizing which is a well known problem for twin-screw pumps providing a large pressure boost to high gas-fraction streams.

Traditionally, twin-screw pumps have rotors designed to provide a uniform volumetric delivery rate along the length of the rotor section composed of sealed chambers. Generally, this is accomplished by building pumps with rotors of a uniform profile over the length of the rotor. From pump to pump, the rotor diameter, pitch, and other rotor characteristics change as required by the application, but on a given pump, the rotor chamber volumetric capacity along the rotor is constant or nearly constant.

Sometimes on a multiphase twin-screw pump the rotors are tapered to a slightly smaller diameter at the outlet end of the rotors to add additional rotor/rotor and rotor/body clearance. At high gas fractions and high pressure boosts, the outlet end of the rotors are significantly heated and the additional clearance allows the pump to operate at higher temperatures. But even for multiphase streams the pitch and other rotor/enclosure parameters are generally chosen to provide constant chamber volumes along the rotors for traditional twin-screw pumps.

This uniform volumetric delivery rotor/enclosure design is used because these pumps generally handle liquids continuously or intermittently. If the volume of the rotor chambers change along the rotor, then the volumetric rate usually changes along the rotor. For a pump which handles liquids, it is usually advantageous to use rotor/enclosure designs which result in a constant volumetric rate along the rotors. To do otherwise without special pump modifications generally results in significant mechanical stresses; the liquids compress, or force themselves through the seals or burst the pump in trying to reach a constant volumetric rate along the rotors.

For highly compressible inlet streams, such as multiphase gas/oil/water production streams from a well, a more efficient twin-screw pump rotor design is possible. This patent proposes an apparatus which allows pumping of all liquid streams and more power-efficient pumping of highly compressible multiphase streams. The pumping system may be called a multistage twin-screw pump. The rotors have separate pumping sections or stages separated by non-pumping chambers. This allows a more power efficient design for multiphase flow. The rotor design along with the auxiliaries design provides a pump also able to handle incompressible streams.

Figure 1:
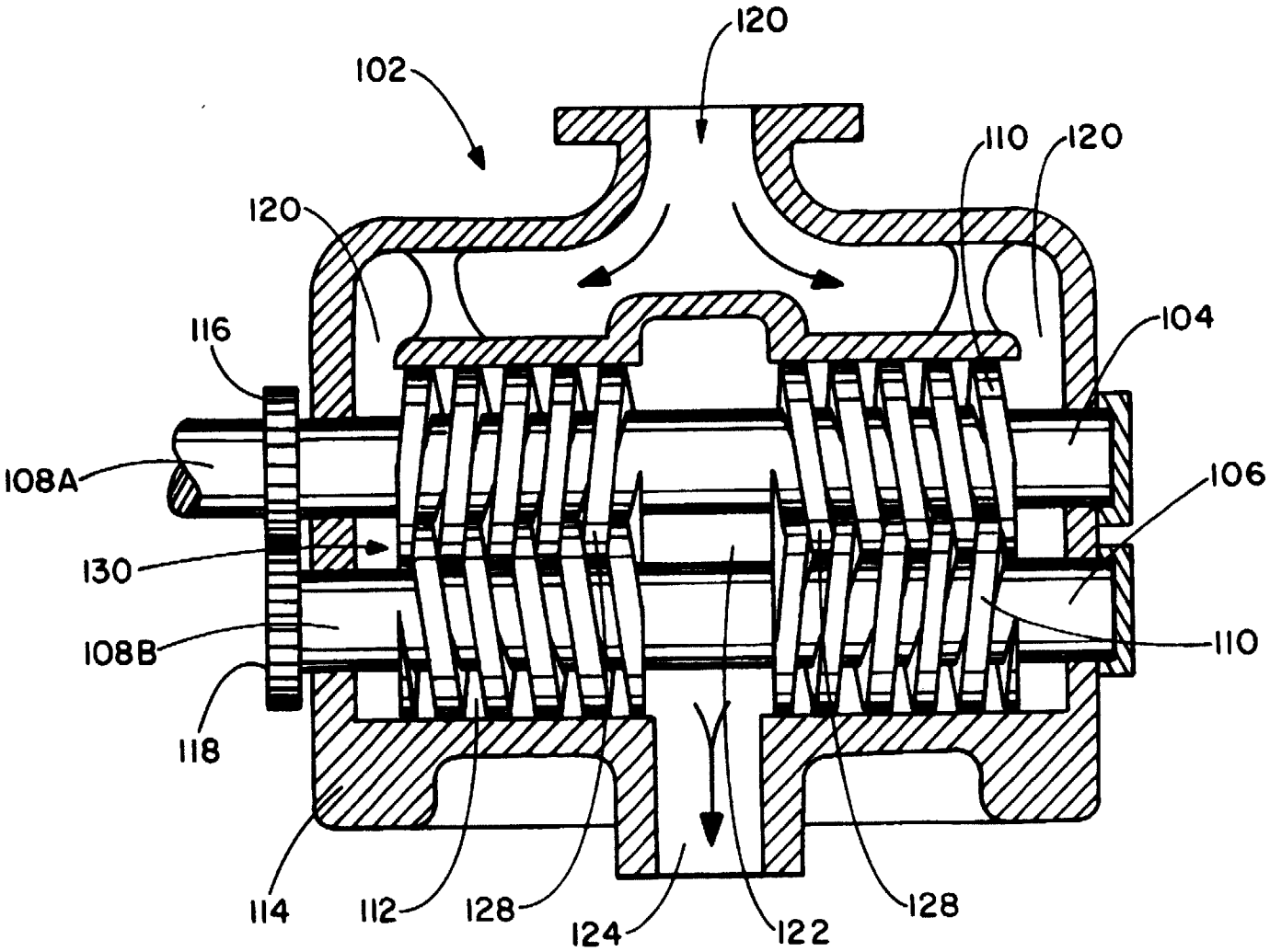
FIG. 1 is a cross-sectional view of a prior art twin-screw pump.

FIG. 1 shows a cross-sectional view of a typical twin-screw pump 102 that is commercially available. The twin-screw pump 102 has two rotors 104 and 106 that are embodied within a close-fit casing or pump housing 114. Each rotor has a shaft 108A and 108B with one or more outwardly extending screw threads 110 coiled around the shaft for at least a portion of the length of the shaft. The shafts 108A and 108B run axially within two overlapping cylindrical enclosures, collectively, a rotor enclosure 130. The two rotors do not touch each other, but the two rotors have threads of opposed screws (for example, on the right half of the rotors, shaft 108A may have left-hand threads and shaft 108B right-hand threads) that are intertwined such that chambers 112 are formed within the rotor enclosure 130. Pump 102 will often be driven by a motor (not shown) which rotates rotors 104 and 106. A drive gear 116 on shaft 108A engages a second gear 118 on shaft 108B, such that when rotor 104 is turned by the pump motor, rotor 106 is turned at the same rate but in an opposite direction.

Wellhead fluids, including particulate material, are drawn into pump 102 at inlets 120. Most twin-screw pumps have inlets on the outer ends of the rotors and an outlet in the center of the pump. Thus, as the rotors are turned, the threads 110, or more properly, the rotor chambers 112, of the rotors displace the wellhead fluids along the rotor shafts 108A and 108B towards the center of the rotors, where the wellhead fluids are discharged. At the center of the rotors there is an outlet chamber 122, an area in the middle of the pump where the rotor shafts are exposed and are not threaded. When the fluids reach the center of the rotors, the point of greatest pressure, the fluids are discharged from the pump 102 through outlet 124.

In order to fully appreciate the advantages of the present invention, it is necessary to understand how twin-screw pumps work when pumping a multiphase fluid stream and when pumping incompressible fluids. The rotor threads of a twin-screw pump interact with each other and the rotor enclosure to form a number of chambers 112. As the rotors turn, the chambers move from the inlet end of the pump to the outlet end of the pump. The chambers are not completely sealed, but under normal operating conditions the normal clearance spaces (or seals) that exist between the rotors and between each rotor and the rotor enclosure 130 are filled with liquid. The liquid in these clearance spaces, or seals, serves to limit the leakage of the pumped fluids between adjacent chambers. The quantity of fluid that does escape from the outlet side of the rotor back toward the inlet through these seals represents the slip of the pump.

When pumping incompressible fluids, such as liquids, the pressure difference between adjacent chambers is nearly the same for all adjacent pairs of chambers. The total pressure boost is the sum of all these pressure differences (where the inlet and outlet chambers are considered the first and last chambers). The pressure difference between adjacent chambers forces some fluid through the seals (i.e., slippage). However, since the pressure difference between adjacent chambers is about the same across the length of the rotor, then the slippage rate between each pair of adjacent chambers is about the same. Consequently the work and heat generation of the rotor is fairly uniformly distributed along the length of the rotors when pumping incompressible fluids. Furthermore, the outlet volumetric delivery is nearly constant with time.

In contrast, when pumping highly compressible fluids, such as high gas-fraction multiphase streams, the pressure difference between adjacent chambers changes significantly from the ends to the middle of the rotors. The largest pressure difference is between the outlet chamber 122 and the sealed rotor chamber nearest the outlet chamber 128. Consequently the fluids slippage rate across the seal between chambers is greatest between the outlet chamber 122 and the last rotor chambers 128 nearest the outlet chamber. Since the fluids in the last rotor chamber 128 are highly compressible, the fluids that flow across the seal between the outlet chamber 122 and the last rotor chamber 128 do not result in a large pressure increase in the last rotor chamber 128.

The next largest pressure difference, and fluids slippage rate, is between the rotor chamber nearest the outlet and the adjacent rotor chamber. The closer an adjacent chamber pair is to the inlet, the smaller the pressure difference, and fluids slippage rate, between chambers. As a consequence of this, twin-screw pumps at a given speed of revolution have a more constant inlet volumetric rate for multiphase flow than for incompressible fluid flow as a function of pressure boost of the pump.

When the fluid steam is highly compressible and the greatest pressure difference is between the last rotor chamber 128 and the outlet chamber 122, the volumetric output of the pump is not constant. The volumetric rate delivered to the outlet chamber 122 becomes negative as the last rotor chamber 128 opens to the outlet chamber 122 (the fluids from the outlet chamber 122 flow into the opened chamber). As the rotor turns, the outlet volumetric rate becomes positive, since all, or at least most, of the fluids in the last rotor chamber 128 at the time it opened to the outlet chamber 122 (aside from fluids that slip though the seals into the adjacent lowerpressure rotor chamber) will ultimately be delivered to the outlet chamber 122 before the next rotor chamber opens to the outlet chamber.

Consequently, when pumping highly compressible fluids with a twin-screw pump, a very large part of the compression occurs as the last rotor chamber 128 opens to the outlet chamber 122, and a substantial part of the overall work is done by the section of the rotor thread forming the seal between the outlet chamber and the last rotor chamber. This disproportionate amount of work by that rotor element generates large quantities of heat in that rotor section. Thus, the rotor sections adjacent to the outlet chamber 122 generate the greatest quantity of heat along the length of the rotor. As the gas fraction increases, the compressibility of the fluid stream increases, and a greater part of the total heat generated by the rotors is concentrated in outlet chamber 122 and the rotor sections adjacent to outlet chamber 122. This is where and when pump seizing is most likely to occur.

Figure 2:
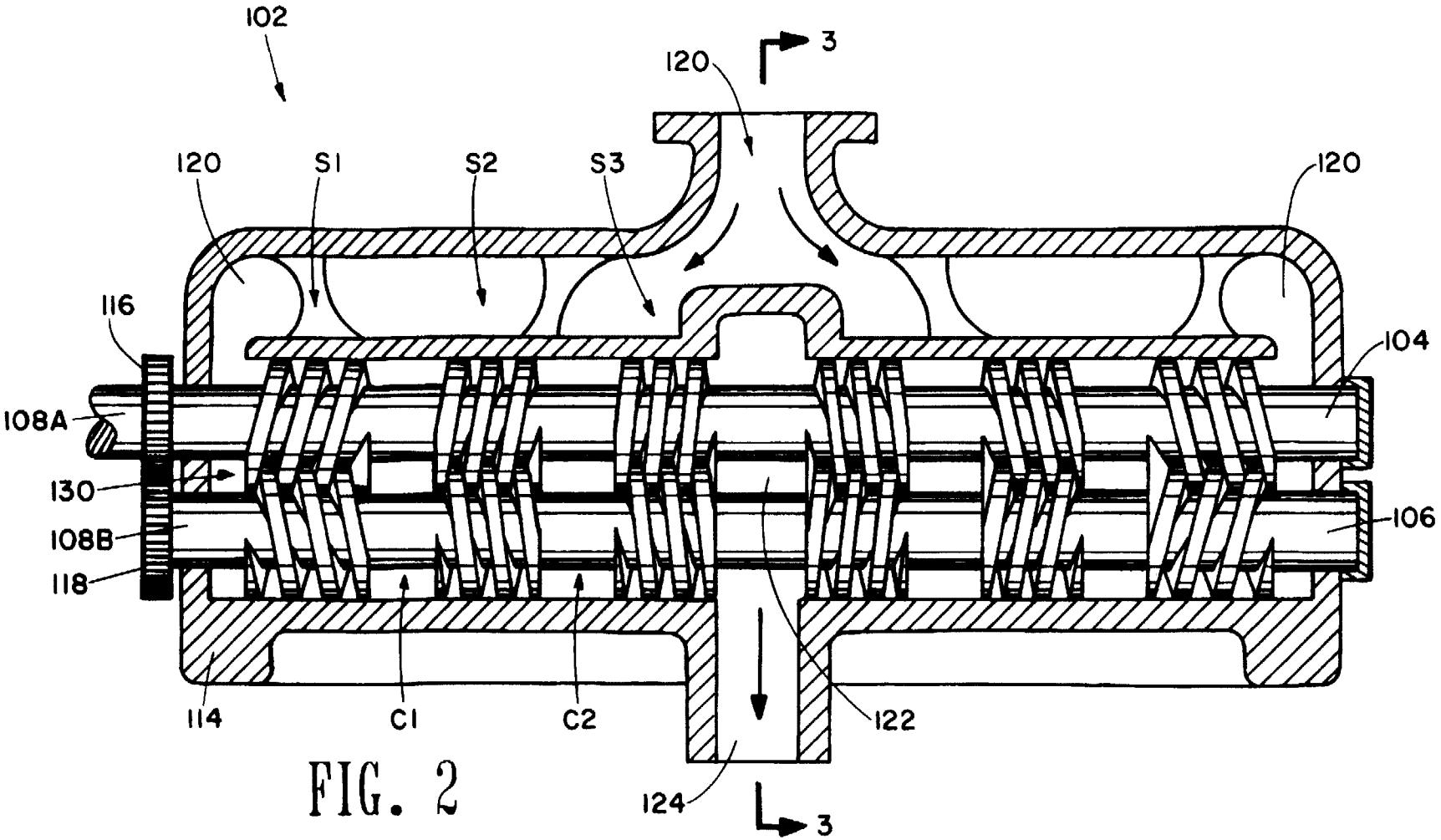
FIG. 2 is a cross-sectional view of an embodiment of a multistage twin-screw pump of the present invention.

FIG. 2 is a cross-sectional view of an apparatus adapted to carry out the present invention. Although the view and the discussions below are of a pump with inlets at the ends of the rotors and an outlet at the middle of the rotors, this invention applies equally to pumps with outlets at the ends of the rotors and an inlet at the middle of the rotors. As in a traditional twin-screw pump, the multistage pump 102 has rotors 104 and 106 that drive the fluids within the rotor enclosure 130 from the inlets 120 to the outlet 124. In this embodiment, however, the threads on each half of the rotor shafts 108A and 108B between the inlet and outlet are not continuous, but rather are separated into three sections or stages SI, S2, and S3 by two non-pumping chambers C1 and C2 which do not have any threads.

Figure 3:
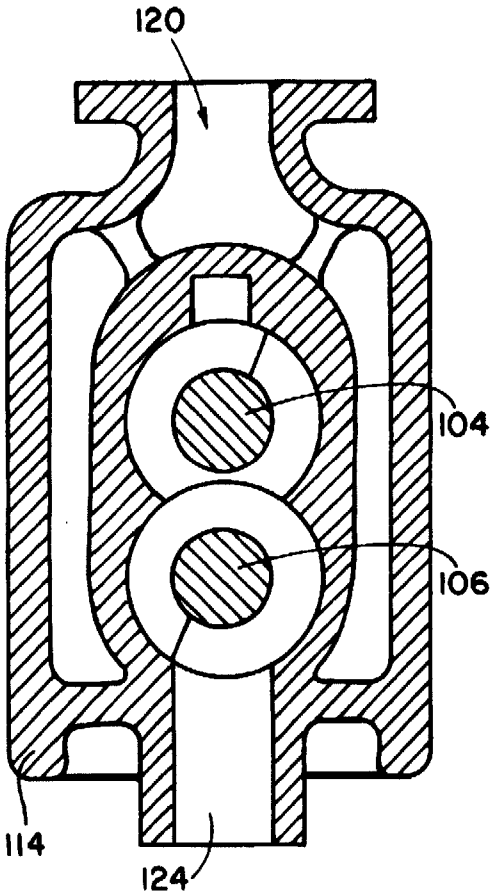
FIG. 3 shows a cross section of the multistage twin screw pump of FIG. 2 taken along the section 3—3.

As discussed previously, the pump 102 of the present invention has rotors 104 and 106 that run axially within a rotor enclosure 130 of the pump housing 114, which may be a solid or split casing design with or without sleeves. While a horizontal axis of rotation for the rotors is shown, the present invention is equally effective for pumps having a vertical or other axis of rotation. FIG. 3 provides a cross-section of the pump. A pump drive (not shown) is connected to the power shaft 108A which rotates rotor 104. A drive gear 116 engages a second gear 118, such that when rotor 104 is turned by the drive, rotor 106 is also turned at the same rate but in an opposite direction. Of course, instead of being geared, the rotors may be direct-connected, belted, or chain-driven by the drive. The drive may be any form of prime mover and source of power practical for the circumstances, such as electric motors, gasoline or diesel engines, or steam and water turbines. Furthermore, mechanical seals may be used to provide a fluid-tight seal between the rotating shafts 108A and 108B and the stationary pump housing 114. Wellhead fluids are drawn into pump 102 at inlets 120 and are displaced along the axis of the shafts 108A and 108B towards the center of the rotors, where the wellhead fluids are discharged through outlet 124. A pipeline is attached to the outlet 124 for transporting the fluids to a remote processing site.

The advantage of having separate sections or stages is that the rotor and enclosure design in each section may be different. For example, the axial pitch of the rotor, that is, the axial distance from any point on one thread to the corresponding point on the next thread may be decreased from stage to stage. Further, the lead angle, that is, the angle between the thread of the rotor helix and a plane perpendicular to the axis of rotation may also be decreased. Likewise, the helix angle, that is, the axial distance the rotor helix advances in one complete revolution around the pitch surface may also be decreased. Other parts of the rotor/enclosure design—such as the enclosure dimensions, shaft diameter, and thread shape as a function of distance from the shaft—may be changed from stage to stage. This allows the inlet volumetric rate of each stage to be different, which allows the pump to be more efficient when pumping multiphase streams. (In this embodiment, the rotor/enclosure design may change within a stage as long as this does not significantly change the volumetric rate.) Because these streams are compressible, as the pressure rises, the volumetric rate (at that pressure) decreases. The multistage pump 102 is designed so each successive stage from the inlet to the outlet has a smaller stage inlet volumetric rate than that of the previous stage. That is, the last stage S3 before the outlet 124 has the smallest stage inlet volumetric rate, the middle stage S2 has an intermediate stage inlet volumetric rate, and the stage S1 at the inlet 120 has the largest stage inlet volumetric rate.

In order for all the fluids that flow into the inlet 120 of the pump to flow through the middle stage S2, the first stage S1 must compress the fluids from the inlet volumetric rate the first stage can handle to the smaller stage inlet volumetric rate that the middle stage can handle. Similarly, in order for all the fluids that flow into the middle stage S2 to flow through the last stage S3, the middle stage must compress the fluids from the stage inlet volumetric rate of the middle stage to the smaller stage inlet volumetric rate of the last stage. If the three stages were all of the same design, then the first and middle stages would do very little work on a compressible stream (only enough to compensate for temperature increases and slip) since very little work would he required to provide the same volume of fluids to the last stage as entered the first stage.

In essence, the last stage S3 takes its suction from the discharge of the middle stage S2 which takes its suction from the discharge of the first stage S1. By designing the pump to have stages acting in series within a single housing with progressively smaller stage inlet volumetric rates through which the flow progresses from inlet to outlet, a significant efficiency improvement can be achieved for highly compressible inlet streams.

For ease of discussion, only one half of the rotor is discussed. As depicted in FIG. 2, an even number of stages are mounted on one shaft, one half facing one direction and the other half facing in the opposite. In this arrangement, the axial thrust of one half is balanced by the other. Nevertheless, since a pump is primarily a product of a foundry or machine shop and can wear with time, minor irregularities result that may cause differences in eddy currents around the rotor stages, the pump must be designed to take some thrust in either direction. The rotors, as well as the other parts of the pump, may be manufactured of almost all known common metals or metal alloys, such as cast iron, bronze, stainless steel, as well as of carbon, porcelain, glass, stoneware, hard rubber, and even synthetics. If desired, two or more pumps of similar multistage design may be used in series or parallel connected by external piping to meet extreme pumping demands.

Each pump manufacturer has proprietary rotor and pump designs. Some manufacturers use rotors with single leads, that is with only one thread wrapping around each rotor half. Other manufacturers use rotors with multiple leads, that is, with two or more inter-spaced threads wrapping around each rotor half. In addition, the shaft diameter and enclosure dimensions may be altered. While the threads must be made to fulfill the rotor-rotor and rotor-body sealing requirements, there are a great number of variables such as pitch of the thread, number of leads, shaft diameter, and profile of the thread that the manufacturers can and do vary from rotor to rotor to meet these requirements. Of critical importance to this invention is that for a given rotor enclosure the volume of a rotor chamber may be varied by changing the rotor/enclosure design. Since the inlet volumetric rate of each stage is basically the volume of a rotor chamber of that stage times the number of chambers formed in a unit of time by the rotation of the rotors, the inlet volumetric rate may be decreased a desired amount from one stage to the next by appropriate rotor/enclosure design changes from one stage to the next.

The efficiency improvement may be seen as follows. In simplified terms, the power required by a twin-screw pump is proportional to the inlet-volumetric-rate times the pressure-boost. As such, it is simple to compare the efficiency of a traditional pump to that of a multistage pump. Let the pressure boost of each of the three stages of a multiple-stage pump be $DP_1$, $DP_2$, and $DP_3$ —so that the total pressure boost of the three stage pump is DP, where $DP=DP_1+DP_2+DP_3$.

Now compare the efficiency of the three stage pump to that of a traditional pump with the same total pressure boost of DP and same inlet volumetric rate. Roughly, the power required, $P_1$, of the traditional pump for an inlet volumetric rate of Q is equal to a constant, C, times DP times Q; put differently, $P_1=C\times DP\times Q$. Or, since DP is equal to the sum of the three stage DP's:

$$P_1=C\times(DP_1\times Q+DP_2\times Q+DP_3\times Q) \quad \text{Equation 1}$$

Now the power required of the three stage pump, $P_3$, is just the sum of the powers required for each stage. For each stage, the power required is the same constant, C, times DP for that stage, times the stage inlet volumetric rate $Q_2$, where i can be 1,2, or 3 for stages 1,2, or 3 respectively. Thus the power required for the three stage pump, $P_3$, is $P_3=C\times DP_1\times Q_1+C\times DP_2\times Q_2+C\times DP_3\times Q_3$. Or, by collecting terms:

$$P_3=C\times(DP_1\times Q_1,+DP_2\times Q_2+DP_3\times Q_3) \quad \text{Equation 2}$$

The power efficiency improvement of the three phase pump can be seen by comparing Equation 1, the power required of a traditional pump, to Equation 2, the power required of a three phase pump. The only difference is that in Equation 1 all the terms have Q, and in Equation 2 the terms have $Q_1$, $Q_2$, and $Q_3$. Now Q the volumetric rate at the pump inlet is equal to $Q_1$, since the pumps are sized to handle the same inlet volumetric rate. However, $Q_2$ is less than $Q_1$ by design and therefore less than $Q_1$ Therefore the term in Equation 2 for the power requirement of the second stage is less than the corresponding term in Equation 1 for the traditional pump by a factor of $Q_2/Q_1$ Furthermore, $Q_3$ is even smaller than $Q_2$,and consequently the term in Equation 2 for the power requirement of the last stage is less than the corresponding term in Equation 1 for the traditional pump by a factor of $Q_3/Q$.

So it is easy to see that the efficiency improvement of the multi-stage twin-screw pump over the traditional twin-screw pump is a consequence of the reduced stage inlet volumetric rate capacities of the rotors stages downstream of the first stage. The extent of the efficiency improvement depends on the stage inlet volumetric rate reduction as compared to the pump inlet volumetric rate, and the pressure boost of each stage. The stage inlet volumetric rate for each stage is determined by the speed of revolution (the same for all stages) and the design of the rotor/enclosure for that stage (as discussed above).

A significant advantage of this invention is that the stages can be designed such that for high gas-fraction multiphase streams the problems associated with seals loss and overheating/seizing are reduced as compared to a traditional twin-screw pump. The first stage can provide a modest pressure boost and associated liquid fraction increase. The next stage can further increase the pumped stream pressure and liquid fraction. And so on, until the last stage, which is provided a reasonable liquid fraction to allow significant further pressure boosting. The system is thus designed to reduce the likelihood of pump seizing, of loss of pump seal, and to reduce power requirements for highly compressible inlet streams. The fact that less power is used means that less heat needs to be dissipated. This, together with the fact that the work may be more evenly distributed along the rotor than for traditional pumps, significantly reduces the likelihood of overheating, loss of seal, and seizing for a multi-stage pump.

Figure 5:
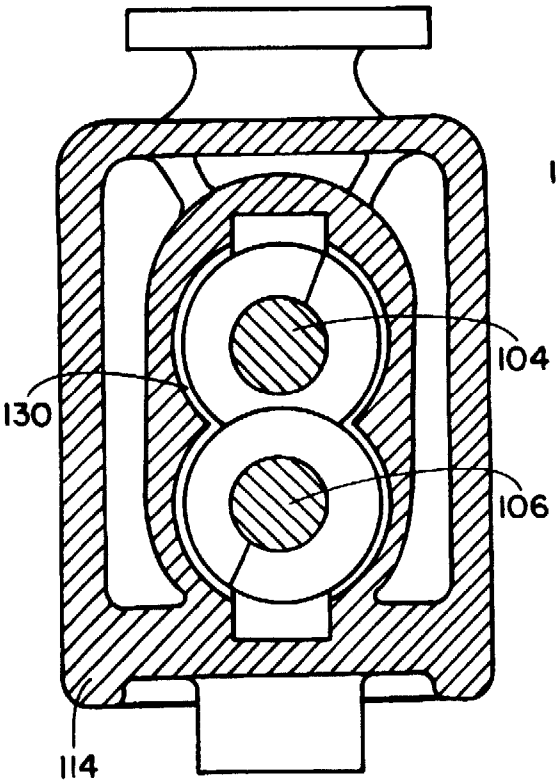
FIG. 5 shows a cross section of the multistage twin-screw pump depicted in FIG. 4, taken along Section 5—5.
Figure 4:
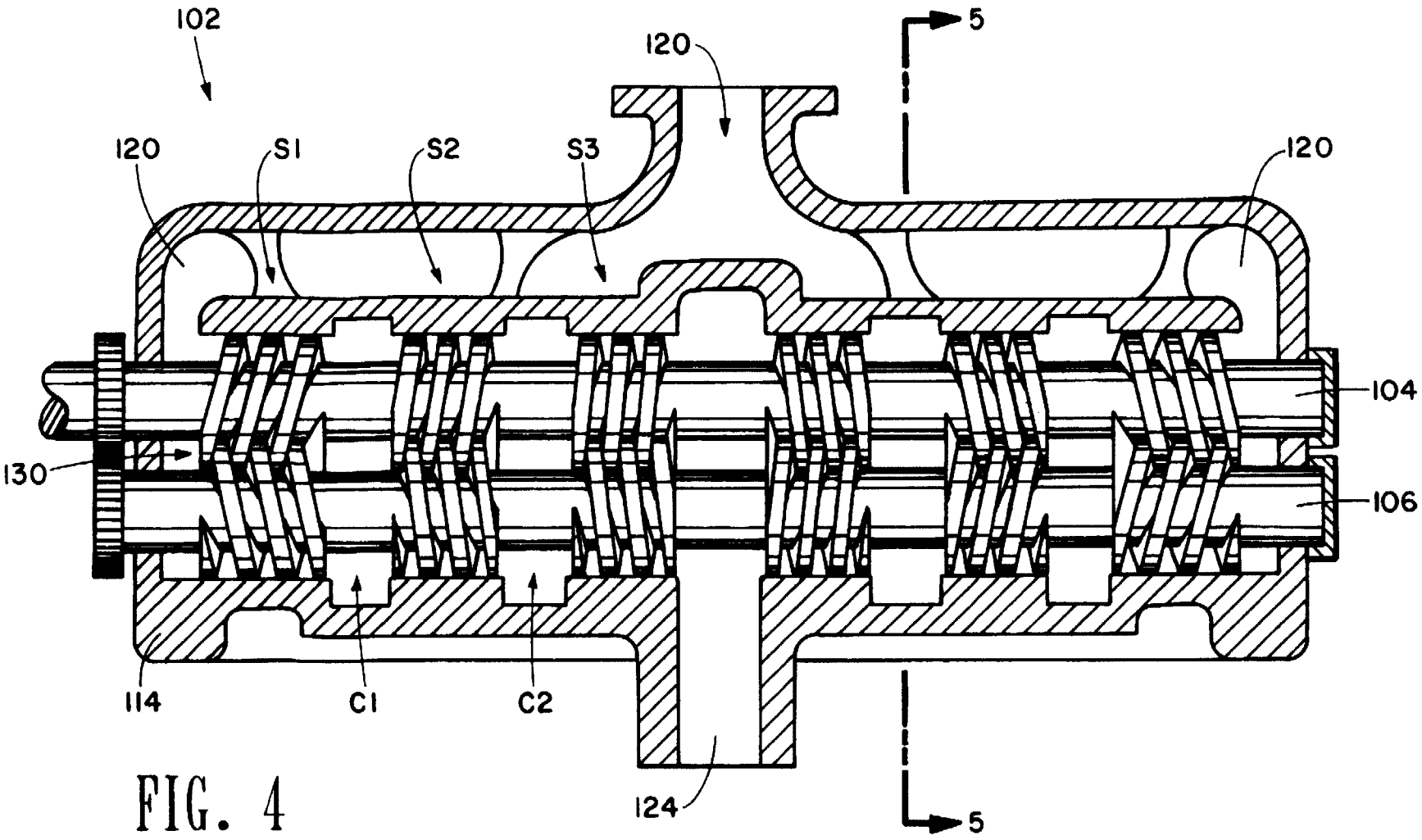
FIG. 4 is a cross-sectional view of another embodiment of a multistage twin-screw pump of the present invention having enlarged non-pumping chambers.

Each of the chambers between stages provides access to the pumped stream. This allows for (1) cooling of the stream before the stream enters the next stage, and/or (2) cooling, sealing, and efficiency enhancements for the previous stage as provided for in co-pending patent application Ser. No. 08/671,697, entitled "Apparatus for Cooling High-Pressure Boost High Gas-Fraction Twin-Screw Pumps," which is incorporated herein by reference. The gathering of the pumped stream liquids in the chambers between stages may be enhanced by increasing the body enclosure dimensions at these chambers. In FIG. 4, there is shown a three stage pump system with increased rotor enclosure dimensions at the chambers C1 and C2 between stages to enhance gathering of the pumped stream liquids which often flow preferentially along the rotor enclosure surfaces. FIG. 5 provides a cross-section along the line 5—5 at the second chamber C2. The cross-section shows how the non-pumping or interstage chamber C2 has a larger rotor enclosure 130 within the pump housing 114.

The discussion of the invention above has focused on the pumping of highly compressible streams. Further discussion is required to explain the performance on liquid or incompressible streams. As was pointed out in the background discussion, traditional twin-screw pumps have a constant volumetric rate capacity along the rotors to avoid severe mechanical stresses when pumping incompressible fluids. The key to understanding how the invention described here with stages with different volumetric rate capacities avoids these mechanical problems is to realize that in this embodiment, while the volumetric rate capacity varies between stages, the volumetric rate capacity is constant within a stage. Consequently, there is not a problem within a stage. But clearly by design each stage after the first can only handle part of the incompressible fluids flow from the previous stage. To accommodate incompressible fluids flow, each of the chambers between the pumping stages is connected to the outlet of the pump and may be connected to a pressure reservoir 700 (see FIG. 7). A mechanism, such as a check valve, prevents flow from the outlet to the chambers. The connections between the chambers and the outlet may or may not have pumps in them.

Figure 7:
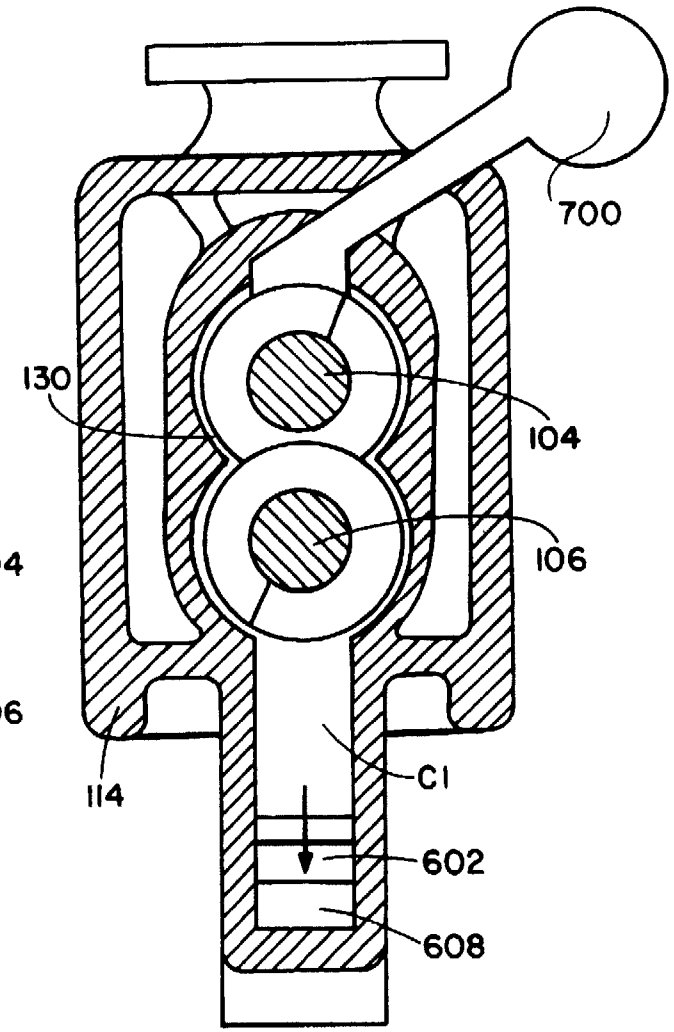
FIG. 7 shows a cross section of the multistage twin-screw pump depicted in FIG. 6, taken along Section 7—7.
Figure 6:
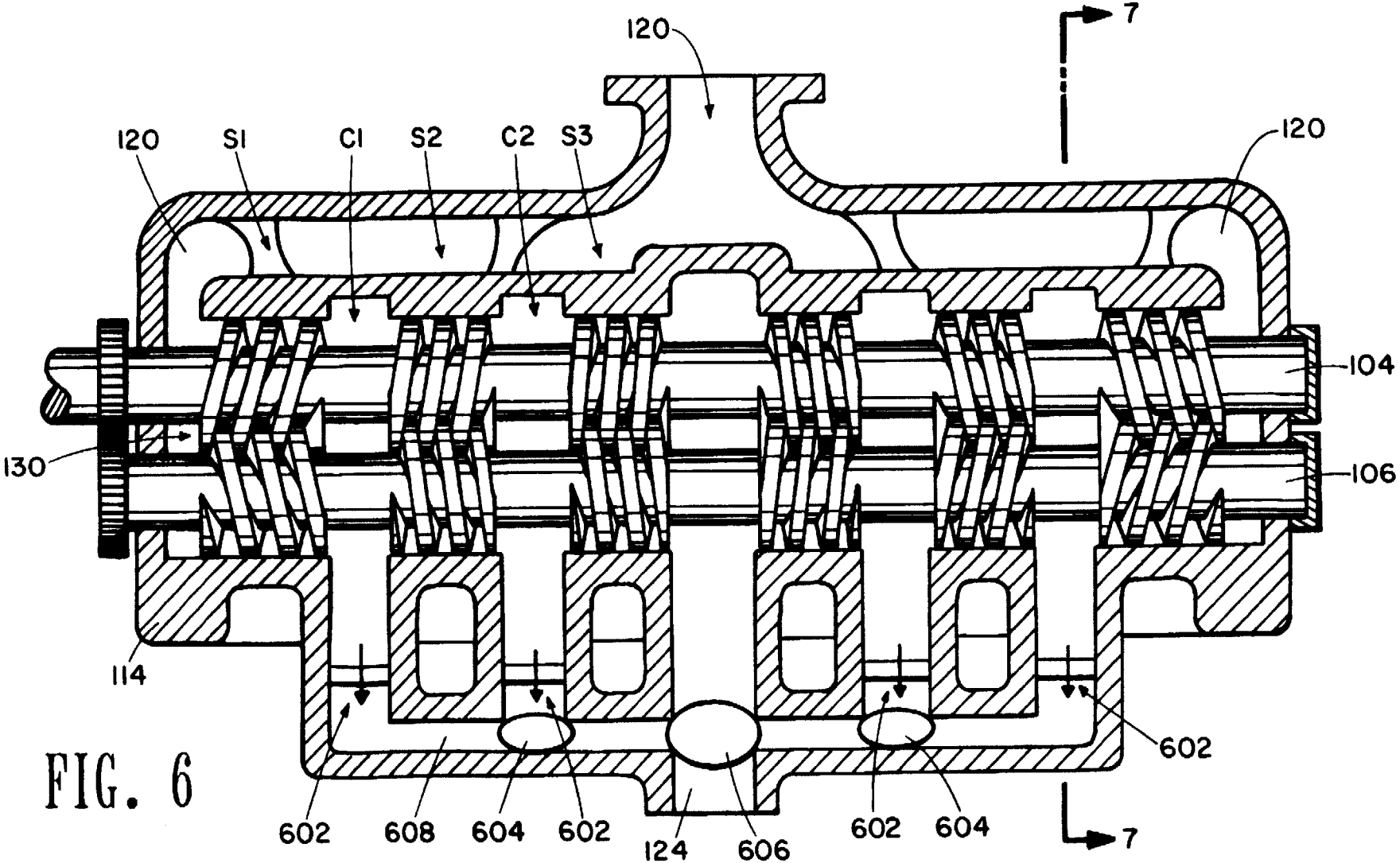
FIG. 6 is a cross-sectional view of another embodiment of a multistage twin-screw pump of the present invention having enlarged non-pumping chambers that are connected.

In FIG. 6, there is shown a three stage pump system capable of handling incompressible fluids. As discussed previously, the rotors 104 and 106 are separated into three sections or stages SL S2, and S3 by two non-pumping chambers C1 and C2 which do not have threads. Unlike the embodiments seen in FIGS. 2 and 4, the chambers C1 and C2 of this embodiment are in fluid connection with each other and with the next interstage chamber or the outlet chamber to accommodate incompressible fluids flow by fluid line 608 to the outlet 124. FIG. 7 provides a cross-section of the pump 102 at the enlarged interstage chamber C2 to show the fluid line 608 which connects with the pump outlet 124. An optional pressure reservoir 700 may be connected to the interstage chamber as in FIG. 7. In the fluid line 608, a mechanism, such as a check valve 602, serves to prevent back flow to the chambers. Downstream of this mechanism, the fluid lines 608 from each interstage chamber may be connected directly to the next interstage chamber pressure reservoir or to a pump driven by the fluids from the next interstage chamber as shown in FIG. 6. This embodiment may also be carried out in the same manner on a multistage pump without enlarged interstage chambers.

If the connections do not have pumps or pressure reservoirs, then the first stage S1 of the pump must pump incompressible liquids to a pressure above the pump outlet pressure. Fluids flow through the other stages, but these stages do not provide a significant pressure rise. Pressure boosting in this way requires the power of a single stage pump while processing incompressible fluids.

In the case that the connections do not have pressure reservoirs, but do have pumps, one way to drive these pumps is with fluids from downstream chambers or the outlet chamber. For example, the excess fluids in the chamber C1 between the first S1 and middle S2 stages may be pumped and then commingled with the excess fluids from the chamber C2 between the middle S2 and last S3 stages. This commingled stream may be pumped and commingled with the fluids in the outlet chamber. A variety of pumps 604 and 606 may be used for the flow in these connections, including pumps with no moving parts such as jet pumps.

The optional pressure reservoirs associated with each interstage or non-pumping chamber allow pumping of incompressible slugs without flow between the stages and between the stages and the outlet through the fluid lines 608. They also allow the pump to run at the same speed while processing incompressible slugs as while processing compressible fluids without a large increase in required power—that is, without using the power of a single stage pump. This is possible for the following reasons. The optional pressure reservoirs are vessels designed to be normally filled with a large volume of compressible fluids—usually gas. The gas is accumulated in these vessels while compressible streams are being pumped through each interstage chamber. When an incompressible slug is pumped by a chamber's upstream stage, not all of the fluids delivered by the upstream stage are pumped away by the smaller inlet volumetric capacity downstream stage. The extra fluids are delivered to the pressure reservoir which then increases slightly in pressure. As long as the volume of extra fluids from the incompressible fluids slug is small as compared to the reservoir volume, then the pressure rise in the reservoir will be small and the power requirement and the efficiency of the pump will only change slightly.

In order to minimize the number of changes between flow and no flow through the connections between the interstage chambers C1 and C2 and the pump outlet 114, larger pressure reservoirs may be used and/or a buffer tank may be installed just upstream of the pump 102 to filter the gas-fractions variations of the inlet stream.

Figure 8:
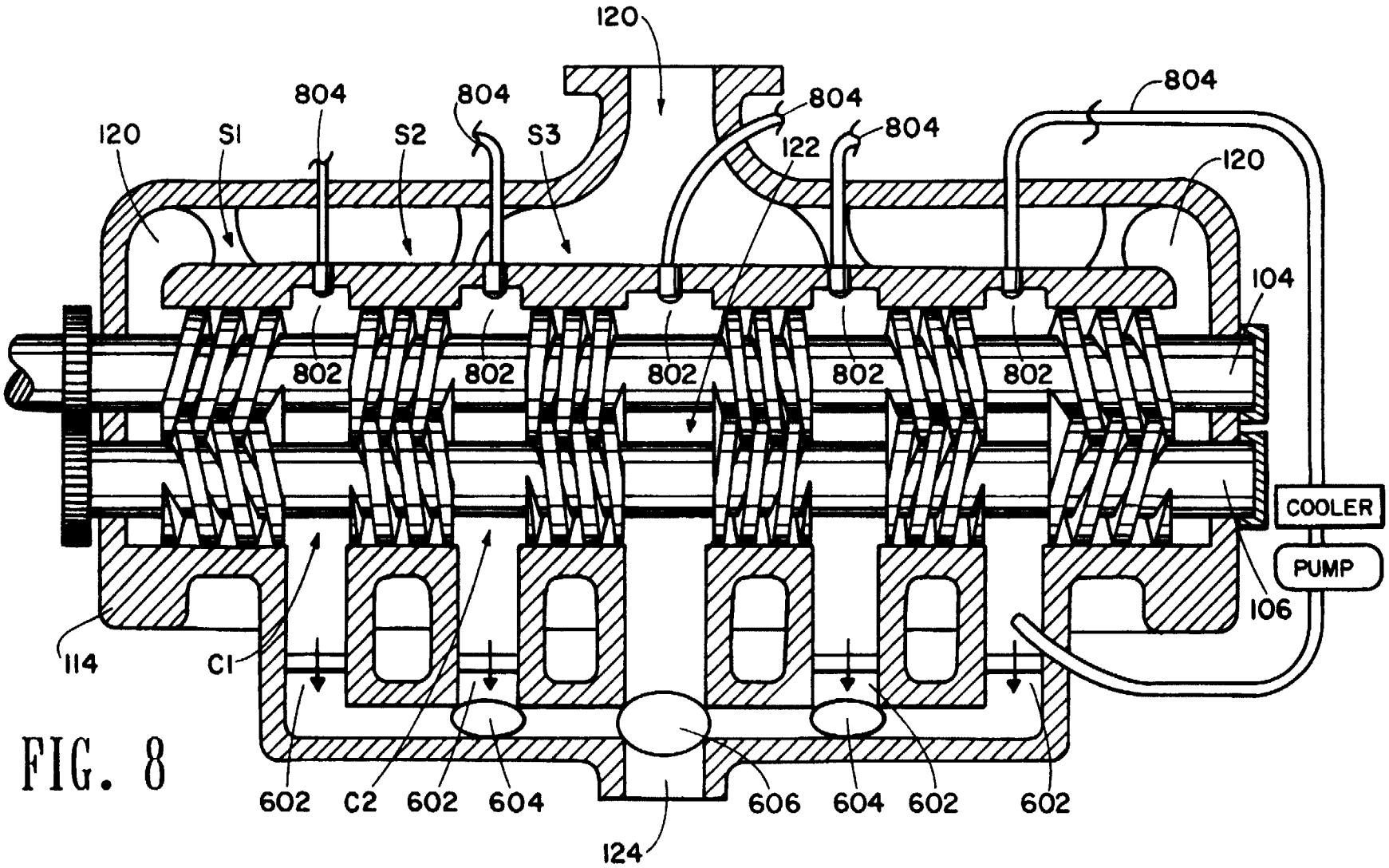
FIG. 8 is cross-sectional view of yet another embodiment of a multistage twin-screw pump of the present invention having a rotor cooling and sealing device.

The multistage pump of the present invention may be combined with rotor cooling, wetting, or other fluids redistribution techniques to enhance the performance of the pump and to further reduce the likelihood of seizing. Referring now to FIG. 8, an embodiment of the present invention is shown in conjunction with a rotor cooling device. A rotor cooling and other fluids redistribution device and its advantages are described in detail in co-pending patent application Ser. No. 08/671,697, entitled "Apparatus for Cooling High-Pressure Boost High Gas-Fraction Twin-Screw Pumps," which is incorporated herein by reference. Each stage of the multistage twin-screw pump may have fluid lines 804 that are implanted in the pump housing 114 so that injectors 802 can spray fluid in the outlet chamber 122, in sealed rotor chambers, or in the interstage chambers C1 and C2, to cool the rotors 104 and 106. A variety of injector configurations may be used.

One embodiment of the present invention would place the injectors 802 in a configuration and at calculated angles, such that the dispensed fluid would hit the rotor shafts exposed in the outlet chamber 122 and will also optimally bathe the rotor threads that are adjacent to the outlet chamber 122 and insert liquid into the last rotor chambers 128 as the rotors turn. The injectors 802 may be implanted in the side of the pump 102 opposite to the outlet 124 as seen in FIG. 8, or the injectors may be implanted in the two sides of pump 102 adjoining the side of the pump having the pump outlet.

Alternatively, feed lines may be implanted in the side of housing 114 across from outlet 124. Feed lines supply cooled liquids into a liquid pool on the opposite side of the outlet chamber 122 from outlet 124. The pool of cooled liquid flows onto accessible rotor parts and into the last rotor chambers 128 adjacent to the outlet chamber 122 when last rotor chambers 128 first open.

Alternatively, liquids from each interstage chamber and the outlet chamber may be allowed to flow after optional cooling in the sealed rotor chambers of the stage upstream of the chamber from which the liquids are obtained. Further embodiments for distribution of the liquids obtained in a chamber to the upstream stage are provided in the above mentioned co-pending patent application. In particular, the multistage twin-screw system with production pump and energy recovery pump should be noted.

For a constant pump speed, as the gas fraction of the inlet stream varies, a multistage twin-screw pump as described here will have the constant inlet volumetric characteristics of a traditional twin-screw pump. The power characteristics will differ from those of a traditional twin-screw pump. If the optional pressure reservoirs are not utilized, then for high liquid fractions, the power consumption will be about the same, but for high gas fractions, the power consumption will be significantly less than with a traditional twin-screw pump. If pressure reservoirs are utilized, then the power consumption for liquid slugs will be significantly reduced also, provided the reservoirs are sized adequately.

Figure 9:
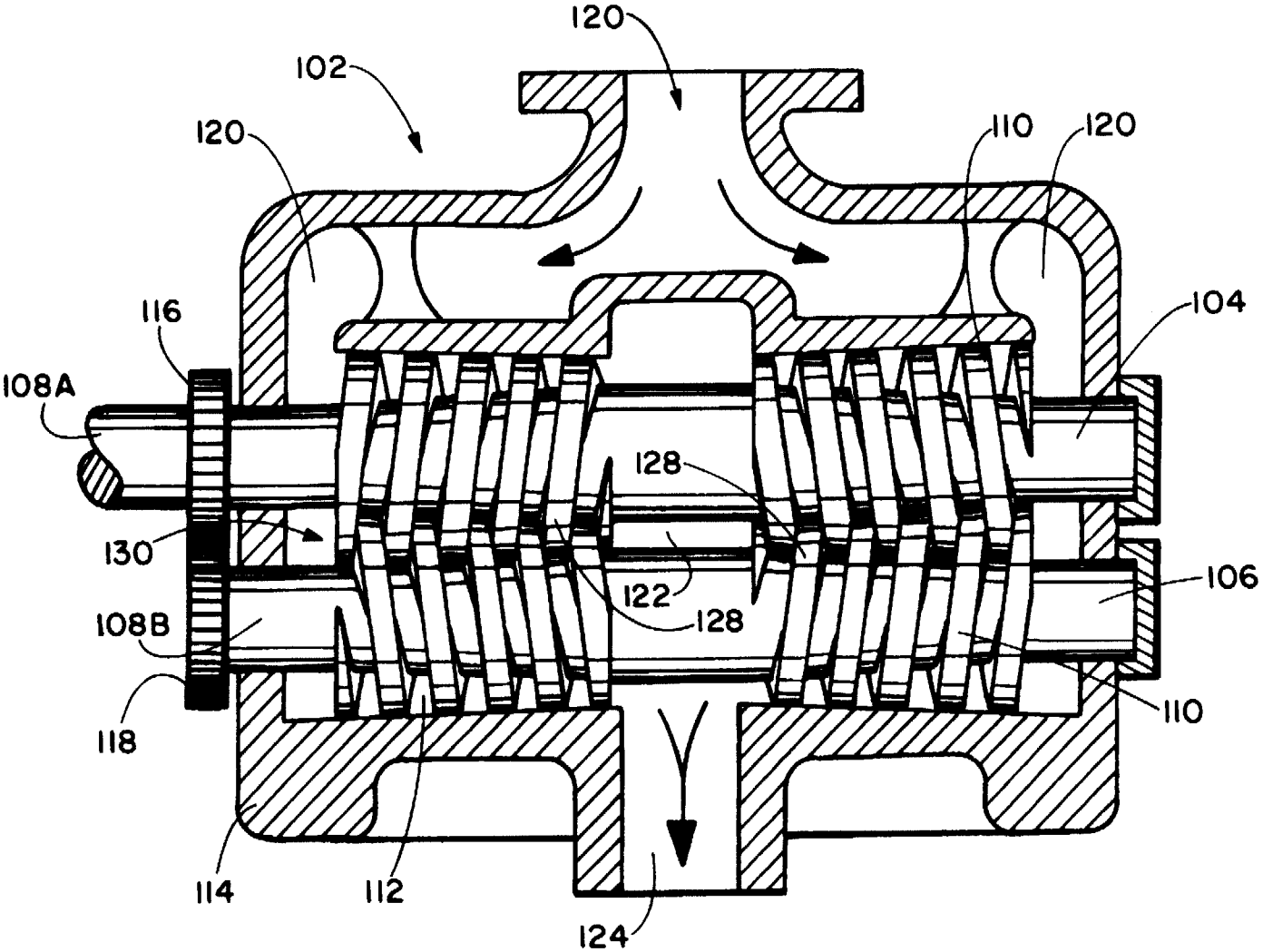
FIG. 9 is a cross-sectional view of a twin-screw pump of the present invention having progressive stages.
Figure 10:
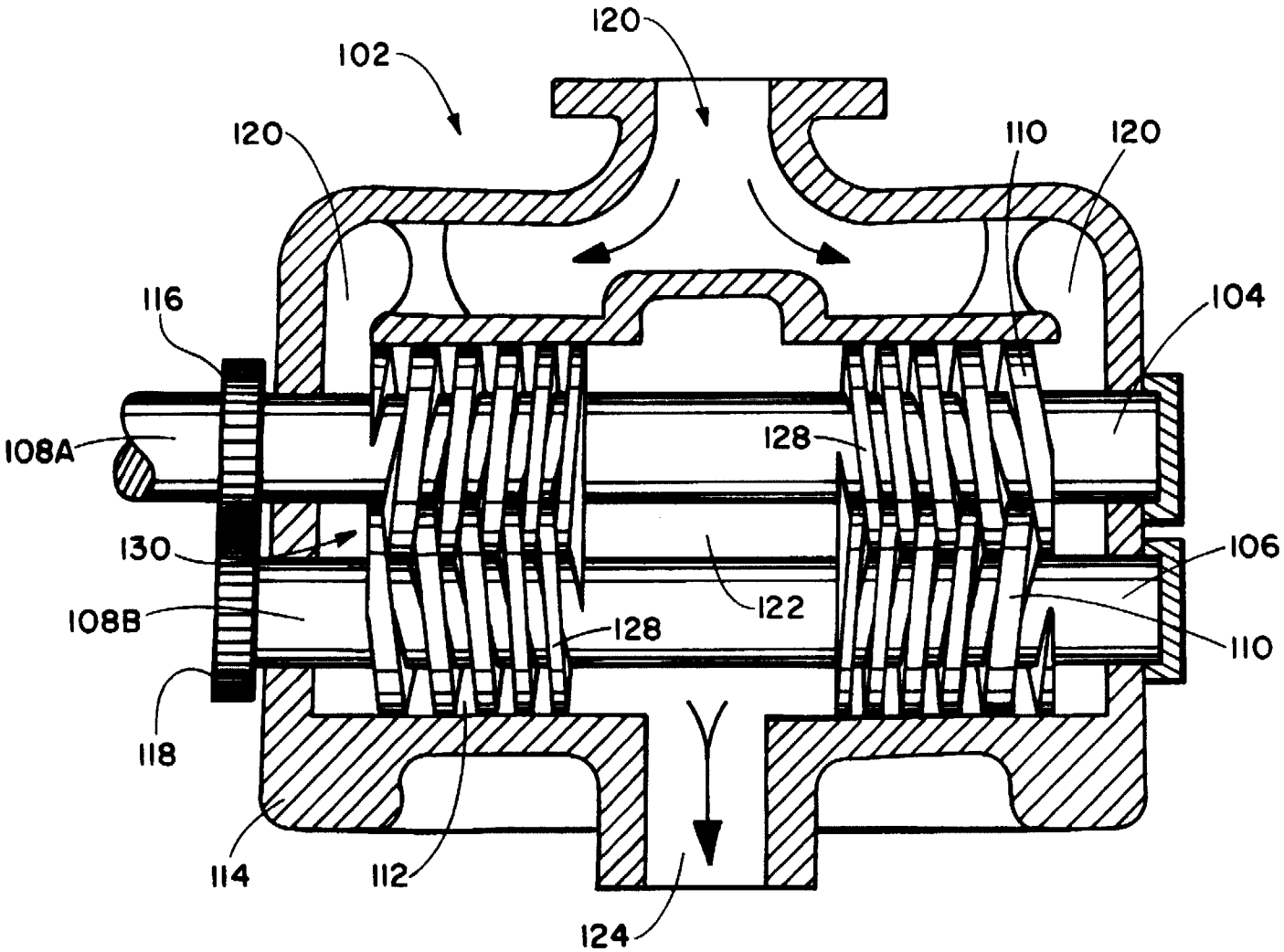
FIG. 10 is another embodiment of a pump having progressive stages.

Yet another embodiment is a single or multistage twin-screw pump with progressive stages in which the diameter of the rotor shafts increases and the cross-sectional area of the rotor enclosures decreases along the rotors from the inlet to the outlet. Another example of a single progressive stage pump is shown in FIG. 10 in which the pitch of the rotor threads changes continuously along the rotors from the inlet to the outlet. For example, a single progressive stage pump is shown in FIG. 9. In a progressive stage, the volume of a rotor chamber decreases as the rotors turn and the chamber moves from the inlet to the outlet. For example FIG. 9 shows a larger shaft diameter, shorter rotor threads, and smaller rotor enclosure at the rotor outlets than at the rotor inlets. Lines to remove excess fluids when the pumped fluids are not as compressible as the fluid stream for which the rotors were designed are necessary. These lines generally have check valves and may be connected to the outlet or to the next higher pressure chamber via a connection which generally has a check valve. As in the previous embodiments, optional pressure vessels may be used to help maintain pump efficiency during periods when the inlet stream is not as compressible as the fluid stream for which the rotors were designed. Improved sealing efficiency and cooling may be provided via liquid injection into the rotor chambers as described in the above mentioned co-pending patent application.

Of course, if the pump is run backwards, then the rotors and enclosures must be designed to take into account that the outlet of the pump is at the end of the rotors and the inlet is in the middle of the rotors.

Although the present invention and its advantages have been described in detail, it should be understood that various changes, substitutions and alterations can be made herein without departing from the spirit and scope of the invention as defined by the appended claims.

What is claimed is:

1. A pump, comprising:

a housing, said housing having an internal rotor enclosure, said enclosure having an inlet and an outlet;

a plurality of rotors operably contained in said enclosure, each rotor having a shaft and a plurality of outwardly extending threads affixed thereon, said rotors being shaped to provide a non-uniform volumetric delivery rate along the length of each rotor, said rotors further having a plurality of threaded pumping stages separated by unthreaded non-pumping chambers, each non-pumping chamber having an increased rotor enclosure diameter; and means for rotating said rotors, whereby a fluid stream entering from said inlet is subjected to a pumping action to transport said fluid stream to exit said enclosure through said outlet.

2. The pump of claim 1, where in each non-pumping chamber is connected to a downstream non-pumping chamber or to the outlet of said rotor enclosure by a plurality of fluid lines.

3. The pump of claim 2, further comprising a plurality of check valves, each check valve connected to a fluid line from a non-pumping chamber to prevent fluids from returning to said chamber after flowing through said check valve.

4. The pump of claim 2, further comprising a pressure reservoir for each non-pumping chamber.

5. The pump of claim 3, further comprising a plurality of pumps connected to a fluid line between said check valve and said outlet for pumping fluids through said fluid lines towards said outlet.

* * * * *